United States Patent [19]

Matsuoka et al.

[11] Patent Number: 4,775,599

[45] Date of Patent: Oct. 4, 1988

[54] COLD ROLLED STEEL SHEETS HAVING AN IMPROVED PRESS FORMABILITY

[75] Inventors: Saiji Matsuoka; Takashi Obara; Kozo Tsunoyama; Shunichi Tsugawa; Shigeru Kobayashi; Toshio Ichida, all of Chiba, Japan

[73] Assignee: Kawasaki Steel Corporation, Kobe, Japan

[21] Appl. No.: 944,679

[22] Filed: Dec. 19, 1986

[30] Foreign Application Priority Data

| | | | |
|---|---|---|---|
| Dec. 24, 1985 | [JP] | Japan | 60-296611 |
| Dec. 24, 1985 | [JP] | Japan | 60-296612 |
| Dec. 24, 1985 | [JP] | Japan | 60-296613 |
| Dec. 24, 1985 | [JP] | Japan | 60-296614 |
| Jul. 28, 1986 | [JP] | Japan | 61-177081 |
| Jul. 28, 1986 | [JP] | Japan | 61-177082 |
| Jul. 28, 1986 | [JP] | Japan | 61-177083 |

[51] Int. Cl.[4] ..... B21D 53/00

[52] U.S. Cl. ..... 428/600; 428/687; 428/925

[58] Field of Search ..... 428/679, 684, 687, 600, 428/601, 923, 925; 29/121.1, 121.8; 72/199

[56] References Cited

U.S. PATENT DOCUMENTS

| | | | |
|---|---|---|---|
| 2,941,544 | 7/1961 | Gotsch et al. | 428/687 |
| 3,619,881 | 11/1971 | Bills et al. | 428/687 |
| 4,071,657 | 1/1978 | Rault | 428/646 |
| 4,679,288 | 7/1987 | Monfort et al. | 29/132 |

FOREIGN PATENT DOCUMENTS

| | | | |
|---|---|---|---|
| 157754 | 10/1985 | European Pat. Off. | 29/121.8 |
| 8330 | 4/1979 | Japan | 428/687 |
| 1045641 | 10/1966 | United Kingdom . | |
| 2040824A | 9/1980 | United Kingdom | 219/121 LM |
| 2069906A | 9/1981 | United Kingdom | 219/121 LM |

OTHER PUBLICATIONS

Cahiers D'Informations Techniques de la Revue de Metallurgie, vol. 80, No. 5, May 1983, pp. 393–401, Paris, Fr. J. Crahay, et al; "Gravure de la Rugosite des Cylindres de Laminoir Par Impulsions Laser".

*Primary Examiner*—John J. Zimmerman

*Attorney, Agent, or Firm*—Balogh, Osann, Kramer, Dvorak, Genova & Traub

[57] ABSTRACT

A cold rolled steel sheet or plated steel sheet having an improved press formability as well as excellent phosphatability, resistance to galling and spot weldability is produced by controlling a surface roughness pattern of the steel sheet so as to satisfy a center-line average surface roughness of 0.3–2.0 μm and a regularity parameter in at least one direction of not more than 0.25 defining the regularity of surface roughness.

18 Claims, 4 Drawing Sheets

COLD ROLLED STEEL SHEETS HAVING AN IMPROVED PRESS FORMABILITY

BACKGROUND OF THE INVENTION

1. Field of the Invention

This invention relates to cold rolled steel sheets and plated steel sheets having considerably improved press formability, phosphatability, weldability and resistance to galling by controlling surface roughness pattern of steel sheet.

2. Related Art Statement

Drawable cold rolled steel sheets used for automobile panels, electric appliances, culinary equipments and so on are required to have an excellent deep drawability. In order to enhance the deep drawability, it is necessary that the steel sheet has high ductility (El) and Lankford value (r-value) as mechanical properties. In fact, the drawing (particularly in the formation of automobile panel) is frequently combined with the flanging, so that work hardening index (n-value) becomes also important.

In the outer panel for the automobile, the finish feeling after painting is an important item directly connecting to the quality of the automobile itself in users.

Furthermore, the pretreatment for baking or phosphatability is important in the steel sheet for automobiles. That is, when the phosphatability is not good, sufficient baking property can not be ensured.

In the steel sheet for automobiles, it is also required to subject the present part to a spot welding, so that the spot weldability of steel sheet becomes important.

In the press forming, there may be caused the seizing between the steel sheet and the press mold, or a so-called galling phenomenon. Such a galling unfavorably causes the damage of the mold, considerable degradation of commercial value of the pressed parts and the like.

In the automobile industry, one-side surface treated steel sheets have hitherto been used as a body plate of an automobile exposed to severer corrosion environment, wherein the inner surface of the steel sheet is a plated or organic coating surface and the outer surface thereof is a cold rolled surface. Even in the outer surface of the body plate, however, rusting or blistering is caused due to the collision with gravels, pebbles and so on. Therefore, both-side surface plated steel sheets have lately been used as the body plate.

Since the steel sheet for automobile is subjected to various press forming prior to the assembling into the automobile body, it is required to have an excellent deep drawability. However, the galvanized steel sheets usually used for the automobile are apt to be seized to the press mold in the press forming due to the presence of galvanized coating as compared with the usual cold rolled steel sheet, and are poor in the deep drawability.

The investigations on deep drawing are made from two viewpoints of steel sheet and drawing technique. However, requirements for the steel sheet tend to become high-grade and deversified together with the accurate increase and complication of the product. Particularly, this tendency is strong in the cold rolled steel sheet for automobile.

For instance, plural pressed parts are spot-welded in the assembling of the vehicle body at the present. Therefore, it is strongly demanded to reduce the number of spot-welded points by oversizing the pressed part or making these pressed parts into one body. On the other hand, the car design becomes more complicated in compliance with the various needs, and consequently difficult molding parts increase in the usual cold rolled steel sheet. In order to satisfy these needs, it is necessary to use cold rolled steel sheets having an improved press formability as compared with the usual cold rolled steel sheet.

In the actual press forming, the mechanical properties (r-value, El, n-value) of steel sheet have hitherto been used as an evaluation standard of press formability, but they are not still insufficient. For instance, the press formability is also largely influenced by the surface roughness of steel sheet, the lubricating oil and the like.

There are some well-known techniques showing an influence of surface roughness of steel sheet upon press formability and so on. For example, *Plasticity and Work*, Vol. 3, No. 14 (1962–3) discloses that when using a high viscosity lubricating oil, the drawability is most improved at the steel sheet surface roughness of about several μm. On the other hand, Japanese Patent Application Publication No. 59-34,441 discloses that the appearance after painting and press formability are more improved by subjecting a cold rolled steel sheet to a skin pass rolling through a dull roll having a center-line average surface roughness of Ra=2.8 (μm) and peak number of PPI=226 as a roll surface roughness.

These well-known techniques are excellent in view of the improvement of press formability, but have a drawback that the surface roughness of steel sheet should be controlled to a certain level.

In Japanese Patent laid open No. 54-97,527 is disclosed a method wherein a cold rolled steel sheet having an improved phosphatability can be produced by subjecting to a skin pass rolling through a roll having PPI=150 as a roll surface roughness. This method provides an excellent phosphatability but does not develop an effect on press formability. In general, the phosphatability is required for the steel sheet used in automobiles, and also the press formability and distinctness of image after painting (DOI) become necessarily important.

The aforementioned conventional techniques do not teach nor suggest a method of producing cold rolled steel sheets and plated steel sheets having an optional surface roughness (Ra, PPI) and excellent press formability, phosphatability, weldability and resistance to galling.

SUMMARY OF THE INVENTION

It is therefore, an object of the invention to solve the above mentioned drawbacks of the conventional technique and to provide cold rolled steel sheets and plate steel sheets having improved press formability, phosphatability, weldability and resistance to galling by giving an orientation to a surface roughness pattern and controlling a center-line average surface roughness, a mean area ratio of convex portions measured at center plane of surface roughness, a mean area per one convex portion at center plane of surface roughness, a mean radius of convex portions measured at center plane of surface roughness and a mean radius of concave portions measured at center plane of surface roughness.

According to the invention, there are provided cold rolled steel sheets and plated steel sheets having an improved press formability, characterized in that the steel sheet has a surface roughness pattern satisfying a center-line average surface roughness (Ra, μm) of 0.3–2.0 μm and a regularity parameter (S) in at least one direction of not more than 0.25 showing a regularity of surface roughness represented by the following equations:

$$S = \frac{1}{n} \sum_{i=1}^{n} \frac{|\overline{X} - Xi|}{\overline{X}}$$

$$\overline{X} = \frac{1}{n} \sum_{i=1}^{n} Xi$$

wherein Xi is a distance between peaks of convex portions at the surface of the steel sheet.

In a preferred embodiment of the invention, the surface roughness pattern further satisfies a mean area per one convex portion at center plane of surface roughness (SGr, $\mu m^2$) of 2,000–30,000.

In another embodiment of the invention, the surface roughness pattern further satisfies a mean area per one convex portion at center plane of surface roughness (SGr, $\mu m^2$) of 2,000–30,000 and at least one requirement selected from a product of center-line average surface roughness (Ra, μm) and mean concave distance (Lmv, μm) of not less than 50, a ratio of mean concave radius (Rmv, μm) to mean convex radius (Rmp, μm) of more than 1, and a mean area ratio of convex portions at center plane of surface roughness (SSr, %) of not less than 45.

BRIEF DESCRIPTION OF THE DRAWINGS

The invention will be described with reference to the accompanying drawings, wherein.

DESCRIPTION OF THE PREFERRED EMBODIMENTS

The invention will be described in detail with respect to results of studies resulting in the success of the invention.

Two cold rolled sheets of low carbon aluminum killed steel having a chemical composition shown in the following Table 1 were used as a steel to be tested.

TABLE 1

| Steel | C | Si | Mn | P | S | N | Al |
|---|---|---|---|---|---|---|---|
| A | 0.032 | 0.02 | 0.21 | 0.013 | 0.008 | 0.0037 | 0.045 |
| B | 0.002 | 0.01 | 0.12 | 0.008 | 0.004 | 0.0026 | 0.032 |

Each of the two test sheets was subjected to a skin pass rolling through a pair of rolls, at least one of which being subjected to a dulling through a laser (hereinafter referred to as a laser dulling), at a draft of 0.8%. In this case, the surface roughness pattern of the steel sheet after skin pass rolling was changed by varying the laser dulling process. The measured results are shown in FIG. 1, wherein S value is a measured value in the rolling direction of the steel sheet.

Figure 1:
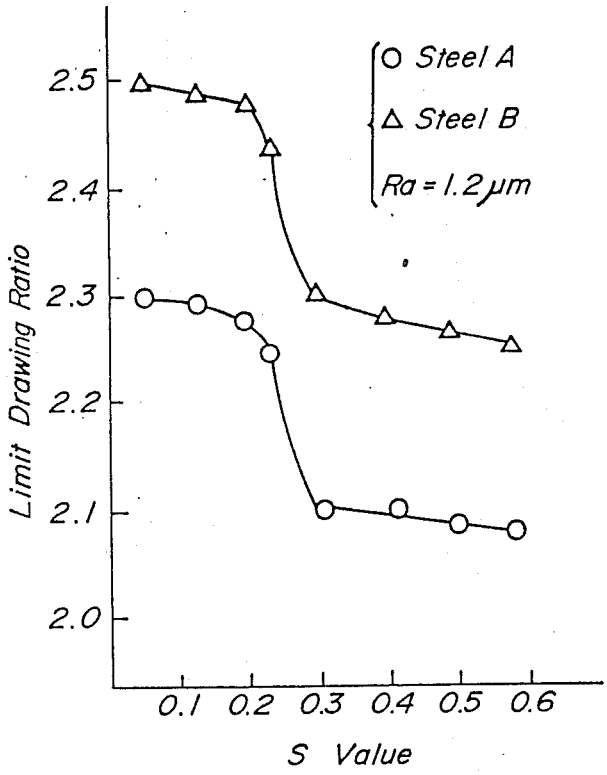
FIG. 1 is a graph showing a relation between regularity parameter (S value) in surface roughness pattern and limit drawing ratio.

As seen from FIG. 1, the center-line average surface roughness (Ra) was about 1.2 μm, while the limit drawing ratio was strongly dependent upon S value. The press formability was considerably improved at $S \leqq 0.25$.

Further, when the mean area per one convex portion at center plane of steel sheet SGr ($\mu m^2$) after skin pass rolling is limited to a range of 2,000 to 30,000, the press formability is further improved and also the distinctness of image is effectively improved.

Figure 2:
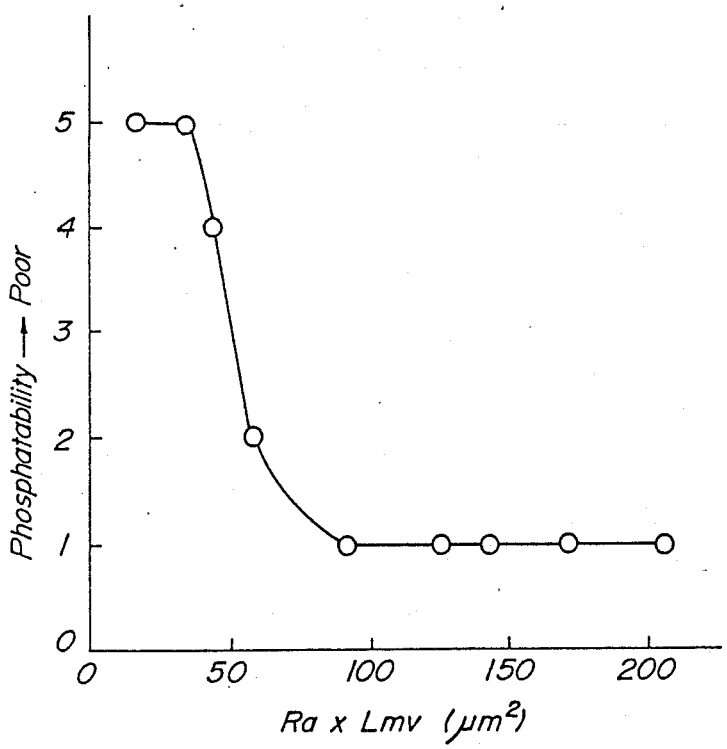
FIG. 2 is a graph showing a relation between product of center-line average surface roughness (Ra) and mean concave distance (Lmv) and phosphatability.

Further, a relation between a product of centerline average surface roughness (Ra, μm) after the skin pass rolling of the steel sheet and mean concave distance (Lmv, μm) and a phosphatability was examined with respect to the steel B of Table 1 to obtain results as shown in FIG. 2. In this case, the draft in the skin pass rolling was 0.8% and S value was 0.18.

The phosphatability was evaluated by pin hole area ratio when the steel sheet was degreased, washed with water, phosphated and subjected to a pin hole test as mentioned later. Moreover, the phosphate treatment was carried out with BT 3112 made by Japan Perkerizing K.K., by adjusting to total acidity of 14.3 and free acidity of 0.5 and then spraying for 120 seconds.

Pin hole test:

A non-covered portion of phosphate crystal coating in the surface of the steel sheet was detected by sticking a filter paper impregnated with a reagent developing a color through reaction with iron ion to the steel sheet surface, which was numeralized as a pin hole area ratio by image analysis. As a standard on the evaluation of phosphatability, 1 is a case that the pin hole area ratio is less than 0.5%, 2 is a case that the ratio is 0.5–2%, 3 is a case that the ratio is 2–9%, 4 is a case that the ratio is 9–15%, and 5 is a case that the ratio is more than 15%. 1 and 2 show evaluation causing no problem in practical use.

As seen from FIG. 2, the phosphatability is largely dependent on $Ra \times Lmv$ and is considerably improved at $Ra \times Lmv \geqq 50$.

Figure 3:
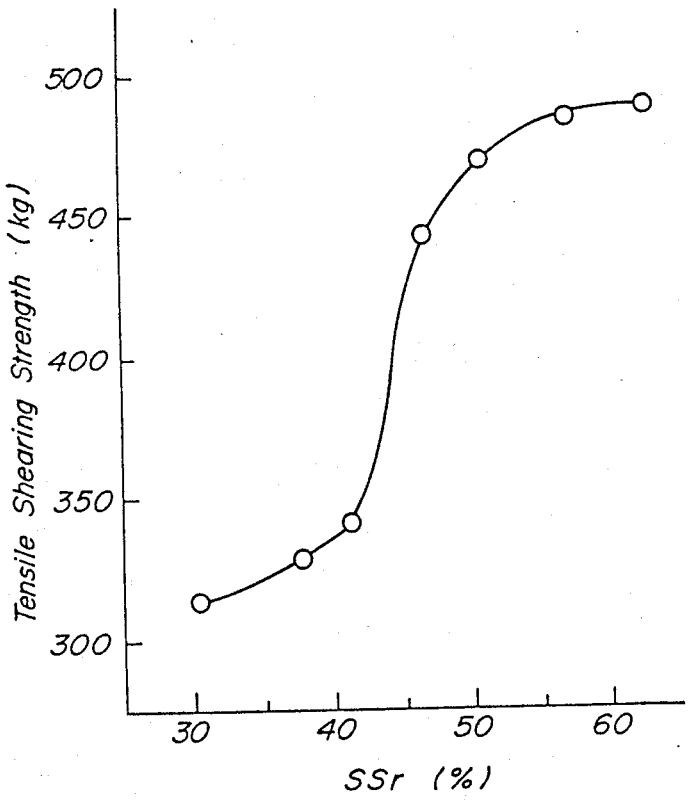
FIG. 3 is a graph showing a relation between mean area ratio of convex portions at center plane of surface roughness (SSr) and spot weldability or tensile sharing strength.

Moreover, a relation between a mean area ratio of convex portions at center plane of surface roughness (SSr, %) and a spot weldability (or tensile shearing strength) was examined with respect to the steel B of Table 1 after the skin pass rolling to obtain results as shown in FIG. 3. In this case, the sheet gauge was 0.8 mm, the draft in the skin pass rolling was 0.8% and S value was 0.15.

The spot weldability was largely dependent upon SSr. The tensile shearing strength after spot welding was remarkably improved at $SSr \geqq 45(\%)$. As spot welding conditions, the welding time was 8 seconds, the pressing force was 190 kg and the welding current was 7,800 A.

Figure 4:
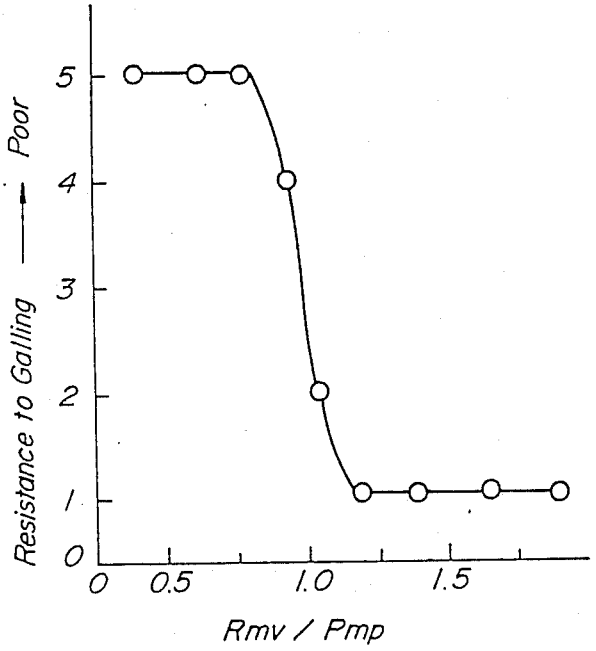
FIG. 4 is a graph showing a relation between ratio of mean concave radius (Rmv) to mean convex radius (Rmp) at center plane of surface roughness and resistance to galling.

And also, a relation between a ratio of mean concave radius (Rmv, μm) to mean convex radius (Rmp, μm) at center plane of surface roughness and a resistance to galling was examined with respect to the steel B of Table 1 after the skin pass rolling to obtain results as shown in FIG. 4. In this case, the draft in the skin pass rolling was 0.8% and S value was 0.16. As seen from FIG. 4, the resistance to mold dropping off is strongly dependent upon Rmv/Rmp and is considerably improved at Rmv/Rmp > 1.

The inventors have made further studies on the basis of the above fundamental data, and found that cold rolled steel sheets and plated steel sheets having improved press formability, phosphatability, spot weldability and resistance to galling can be produced by controlling the production conditions as mentioned below.

At first, the surface roughness pattern of the steel sheet is most important.

Then, the regularity parameter S showing a regularity of surface roughness in the steel sheet according to the invention can be expressed by the following equations when a distance between peaks of convex portions on the steel sheet surface is Xi;

$$S = \frac{1}{n} \sum_{i=1}^{n} \frac{|\overline{X} - Xi|}{\overline{X}}$$

$$\overline{X} = \frac{1}{n} \sum_{i=1}^{n} Xi$$

Figure 5:
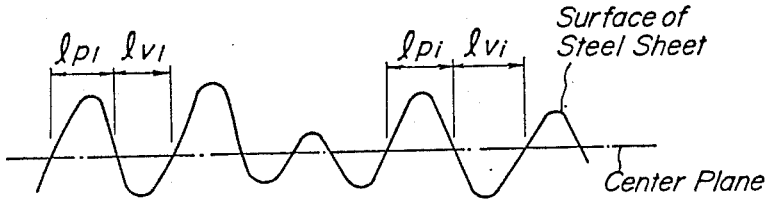
FIGS. 5 and 6 show surface roughness patterns of steel sheets, respectively.

The mean concave distance Lmv is expressed by the following equation in the surface roughness pattern shown in FIG. 5:

$$Lmv = \frac{1}{n} \sum_{i=1}^{n} lvi$$

Figure 6:
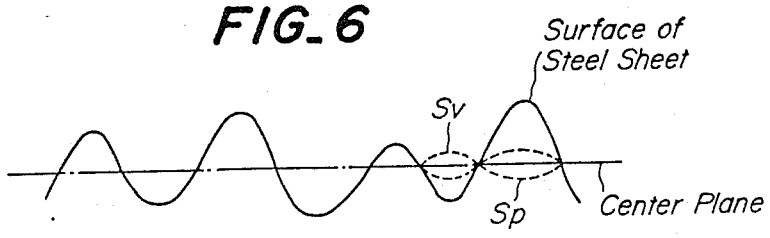

Further, the mean convex radius Rmp and mean concave radius Rmv at center plane of surface roughness are expressed by the following equations in the surface roughness pattern shown in FIG. 6, respectively:

$$Rmp = \sqrt{\frac{Sp}{\pi np}}$$

$$Rmv = \sqrt{\frac{Sv}{\pi nv}}$$

wherein Sp is an area of convex portion at center plane, Sv is an area of concave portion at center plane, np is number of convex portions at center plane and nv is number of concave portions at center plane.

According to the invention, the regularity parameter S is required to satisfy S≦0.25 in at least one direction. When S>0.25, the excellent press formability can not be obtained. In the conventional cold rolled steel sheet, S value is about 0.3–0.5.

The center-line average surface roughness (Ra) of the steel sheet is essential to be within a range of 0.3–2.0 μm. When Ra<0.3 μm, the excellent press formability can not be obtained, while when Ra>2.0 μm, the distinctness of image substantially equal to that of the usually used steel sheet can not be obtained.

The mean area per one convex portion at center plane of surface roughness SGr ($\mu m^2$) is necessary to be within a range of 2,000–30,000. When SGr<2,000, the distinctness of image substantially equal to that of the usually used steel sheet can not be obtained, while when SGr>30,000, the press formability is degraded.

Further, the center-line average surface roughness Ra (μm) and mean concave distance Lmv (μm) are necessary to satisfy a relation of Ra×Lmv≧50. When Ra×Lmv<50, the excellent phosphatability can not be obtained.

The mean area ratio of convex portion at center plane of surface roughness SSr(%) is necessary to be not less than 45%. When SSr<45%, the excellent spot weldability can not be obtained.

Moreover, the mean convex radius Rmp (μm) and mean concave radius Rmv (μm) at center plane of surface roughness are necessary to satisfy a relation of Rmv/Rmp>1. When Rmv/Rmp≦1, the desired resistance to galling can not be obtained.

In order to provide the regular surface roughness pattern satisfying the above requirements on the steel sheet, the surface roughness pattern of skin pass roll should necessarily be regular. For this purpose, the skin pass roll is subjected to a discharge dulling process, a laser dulling process or a shot blast process using a specially formed grid.

According to the invention, the kind of lubricating oil and the pressing conditions are optional.

The effect of the regular surface roughness pattern of steel sheet according to the invention is considered to make good the lubrication condition resulted from the fact that the lubricating oil pooled in concave portions on the steel sheet surface is equally supplied to convex portions. Furthermore, it is considered that the friction state between the steel sheet and the press mold is well improved owing to the fact that metal-contacting parts of convex portions are regularly present on the steel sheet surface.

As to the phosphatability, the surface roughness pattern of the steel sheet is considered to influence the formation of phosphate crystal nucleus, the detail of which is not clear.

Further, it is considered that the spot weldability is improved at SSr≧45% because the bonding property between steel sheet surfaces in the spot welding is good.

As regards the resistance to galling, it is considered that iron powders produced in the press working are apt to flow into concave portions at Rmv/Rmp>1 and mitigate the seizing phenomenon between the steel sheet and the press mold.

The invention will be described in detail with reference to the following examples.

A steel slab having a chemical composition as shown in the following Table 2, 5, 8, 11, 14, 17, 20, 23 or 26 was produced by a converter-continuous casting process, soaked by heating at 1,250° C., and subjected to rough rolling-finish rolling to obtain a hot rolled steel sheet of 3.2 mm in thickness. The resulting steel sheet was pickled, cold rolled to a thickness of 0.8 mm, and subjected to a continuous annealing (soaking temperature: 750°–850° C.) and further to a skin pass rolling (draft: 0.8%).

In this case, a roll dulled by shot blast or laser process was used as a skin pass roll.

The surface roughness of the steel sheet was measured in an L-direction to obtain center-line average surface roughness Ra, ten-point average roughness Rz and regularity parameter S. Further, the mean area per one convex portion at center plane of surface roughness SGr, mean area ratio of convex portions SSr, mean convex radius Rmp and mean concave radius Rmv were determined by using a three-dimensional surface roughness measuring meter.

The tensile properties were measured by using a No. 5 test piece defined in JIS Z 2201. The Lankford value was measured by a three-point method in L-direction (rolling direction), C-direction (90° to rolling direction) and D-direction (45° to rolling direction) under a tensile prestrain of 15%, from which $\bar{r}$-value was calculated according to an equation of $\bar{r}=(r_L+r_C+2r_D)/4$.

The limit drawing ratio (L.D.R.) was calculated according to the following equation by measuring a maximum diameter ($D_O$max) of sheet capable of deep drawing in a mold with a punch having a diameter (dp) of 32 mm:

$$L.D.R. = \frac{D_Omax}{dp}$$

As the drawing conditions, the drawing speed was 1 mm/sec and the lubricating oil was a rust preventive oil (oil type).

Moreover, the plated steel sheet was produced by subjecting the cold rolled steel sheet to a skin pass rolling (draft: 0.8%) and further to zinc electroplating, Zn-Ni alloy electroplating or Zn-Fe alloy electroplating, or by subjecting a cold rolled steel sheet to a zinc hot dipping and further to a skin pass rolling (draft: 0.8%).

EXAMPLE 1

Table 2 shows a chemical composition of a cold rolled steel sheet used, and Table 3 shows a dulling method for skin pass roll, and surface roughness and properties of the steel sheet. As seen from Table 3, the cold rolled steel sheets according to the invention satisfying $0.3 \leqq Ra \leqq 2.0$ and $S \leqq 0.25$ exhibit an excellent press formability as compared with the comparative steel sheets.

TABLE 2

| Steel | C | Si | Mn | P | S | N | Al | X |
|---|---|---|---|---|---|---|---|---|
| C | 0.035 | 0.02 | 0.18 | 0.012 | 0.007 | 0.0038 | 0.046 | — |
| D | 0.002 | 0.01 | 0.11 | 0.007 | 0.004 | 0.0029 | 0.030 | — |
| E | 0.002 | 0.01 | 0.12 | 0.007 | 0.005 | 0.0023 | 0.031 | Ti: 0.028 |
| F | 0.003 | 0.02 | 0.13 | 0.008 | 0.004 | 0.0026 | 0.033 | Nb: 0.015 |
| G | 0.002 | 0.01 | 0.09 | 0.006 | 0.003 | 0.0022 | 0.028 | Ti: 0.014<br>Nb: 0.008 |

TABLE 3

| Steel | Roll dulling method | Surface roughness Ra (μm) | Surface roughness S value | Properties YS (Kg/mm²) | Properties TS (Kg/mm²) | Properties El (%) | Properties $\bar{r}$ | Properties L.D.R. | Remarks |
|---|---|---|---|---|---|---|---|---|---|
| C | shot blast | 1.2 | 0.35 | 20 | 35 | 44 | 1.4 | 2.12 | Comparative Example |
| C | shot blast | 1.3 | 0.41 | 20 | 35 | 44 | 1.4 | 2.09 | Comparative Example |
| C | laser | 1.1 | 0.12 | 20 | 35 | 44 | 1.4 | 2.31 | Example |
| D | laser | 1.3 | 0.23 | 15 | 28 | 50 | 2.0 | 2.48 | Example |
| D | shot blast | 1.2 | 0.50 | 15 | 28 | 50 | 2.0 | 2.28 | Comparative Example |
| E | laser | 1.9 | 0.21 | 16 | 29 | 52 | 2.2 | 2.51 | Example |
| F | laser | 2.0 | 0.18 | 17 | 30 | 50 | 2.1 | 2.53 | Example |
| G | shot blast | 0.6 | 0.38 | 16 | 29 | 51 | 2.2 | 2.31 | Comparative Example |
| G | laser | 0.7 | 0.08 | 16 | 29 | 51 | 2.2 | 2.53 | Example |

EXAMPLE 2

Table 5 shows a dulling method for skin pass roll, kind of plating and surface roughness and properties of the plated steel sheet having a chemical composition as shown in Table 4. As seen from Table 5, the plated steel sheets according to the invention satisfying $0.3 \leqq Ra \leqq 2.0$ and $S \leqq 0.25$ exhibit an excellent press formability compared with the comparative steel sheets.

TABLE 4

| | C | Si | Mn | P | S | N | Al | Ti |
|---|---|---|---|---|---|---|---|---|
| Steel | 0.002 | 0.01 | 0.09 | 0.007 | 0.008 | 0.0022 | 0.064 | 0.041 |

TABLE 5

| | Roll dulling method | Kind of plating | Surface roughness of plated steel sheet Ra (μm) | Surface roughness of plated steel sheet S value | Deep drawability (L.D.R.) |
|---|---|---|---|---|---|
| Example | laser | Zn electroplating | 1.2 | 0.20 | 2.31 |
| Example | laser | Zn—Ni alloy electroplating | 1.5 | 0.15 | 2.33 |
| Example | laser | Zn—Fe alloy electroplating | 1.1 | 0.18 | 2.28 |
| Example | laser (after plating) | Zn hot dipping | 0.8 | 0.09 | 2.34 |
| Example | laser | Zn electroplating | 1.3 | 0.16 | 2.27 |
| Example | laser | Zn electroplating | 1.4 | 0.08 | 2.22 |
| Comparative Example | shot blast | Zn electroplating | 1.2 | 0.32 | 2.07 |
| Comparative Example | shot blast | Zn—Fe alloy electroplating | 1.2 | 0.29 | 2.10 |

EXAMPLE 3

Table 6 shows a chemical composition of a cold rolled steel sheet used, and Table 7 shows a dulling method for skin pass roll, and surface roughness and properties of the steel sheet. As seen from Table 7, the cold rolled steel sheets according to the invention satisfying $0.3 \times Ra \leqq 2.0$, $S \leqq 0.25$ and $2{,}000 \leqq SGr \leqq 30{,}000$ exhibit excellent press formability and distinctness of image after painting as compared with the comparative steel sheets.

TABLE 6

| Steel | C | Si | Mn | P | S | N | Al | X |
|---|---|---|---|---|---|---|---|---|
| C | 0.036 | 0.02 | 0.22 | 0.016 | 0.007 | 0.0044 | 0.047 | — |
| D | 0.002 | 0.01 | 0.16 | 0.009 | 0.004 | 0.0029 | 0.029 | — |
| E | 0.004 | 0.01 | 0.12 | 0.011 | 0.004 | 0.0031 | 0.031 | Ti: 0.035 |
| F | 0.003 | 0.01 | 0.15 | 0.012 | 0.003 | 0.0033 | 0.032 | Nb: 0.021 |
| G | 0.002 | 0.01 | 0.10 | 0.008 | 0.004 | 0.0028 | 0.028 | Ti: 0.016 Nb: 0.009 |

TABLE 7

| Steel | Roll dulling method | Surface roughness Ra (μm) | S value | SGr (μm²) | Properties YS (kg/mm²) | TS (kg/mm²) | El (%) | $\bar{r}$ | L.D.R. | DOI | Remarks |
|---|---|---|---|---|---|---|---|---|---|---|---|
| C | shot blast | 1.2 | 0.33 | 1640 | 18 | 34 | 44 | 1.2 | 2.05 | 85 | Comparative Example |
| C | laser | 1.1 | 0.19 | 3150 | 18 | 34 | 44 | 1.2 | 2.31 | 96 | Example |
| C | laser | 1.2 | 0.16 | 2120 | 18 | 34 | 44 | 1.2 | 2.35 | 95 | Example |
| D | laser | 1.6 | 0.15 | 2530 | 15 | 28 | 51 | 1.8 | 2.49 | 95 | Example |
| D | shot blast | 1.7 | 0.41 | 1230 | 15 | 28 | 51 | 1.8 | 2.33 | 82 | Comparative Example |
| E | shot blast | 0.8 | 0.28 | 1850 | 16 | 29 | 52 | 1.9 | 2.34 | 86 | Comparative Example |
| E | laser | 0.9 | 0.08 | 2430 | 16 | 29 | 52 | 1.9 | 2.58 | 94 | Example |
| F | laser | 1.2 | 0.20 | 3960 | 16 | 28 | 50 | 2.0 | 2.51 | 97 | Example |
| F | shot blast | 1.3 | 0.31 | 1090 | 16 | 28 | 50 | 2.0 | 2.31 | 81 | Comparative Example |
| G | shot blast | 3.1 | 0.36 | 1810 | 17 | 30 | 49 | 1.9 | 2.29 | 87 | Comparative Example |
| G | laser | 2.0 | 0.12 | 2630 | 17 | 30 | 49 | 1.9 | 2.52 | 95 | Example |
| G | laser | 3.0 | 0.18 | 31510 | 17 | 30 | 49 | 1.9 | 2.21 | 88 | Comparative Example |

EXAMPLE 4

Table 9 shows a dulling method for sking pass roll, kind of plating and surface roughness and properties of the plated steel sheet having a chemical composition as shown in Table 8. As seen from Table 9, the plated steel sheets according to the invention satisfying $0.3 \leqq Ra \leqq 2.0$, $S \leqq 0.25$ and $2{,}000 \leqq SGr \leqq 30{,}000$ exhibit excellent press formability and distinctness of image after painting as compared with the comparative steel sheets.

TABLE 8

| | C | Si | Mn | P | S | N | Al | Ti | Nb | B |
|---|---|---|---|---|---|---|---|---|---|---|
| Steel | 0.002 | 0.01 | 0.11 | 0.008 | 0.002 | 0.0028 | 0.052 | 0.014 | 0.008 | 0.009 |

TABLE 9

| | Roll dulling method | Kind of plating | Surface roughness of plated steel sheet Ra (μm) | S value | SGr (μm²) | Deep drawability (L.D.R.) | DOI |
|---|---|---|---|---|---|---|---|
| Example | laser | Zn electroplating | 1.1 | 0.20 | 3210 | 2.30 | 95 |
| Example | laser | Zn—Ni alloy electroplating | 1.6 | 0.16 | 2640 | 2.32 | 93 |
| Example | laser | Zn—Fe alloy electroplating | 1.2 | 0.18 | 2330 | 2.28 | 96 |
| Example | laser (after plating) | Zn hot dipping | 0.9 | 0.09 | 2560 | 2.33 | 94 |
| Example | laser | Zn electroplating | 1.3 | 0.15 | 15630 | 2.26 | 96 |
| Example | laser | Zn electroplating | 1.2 | 0.08 | 28340 | 2.22 | 97 |
| Comparative Example | shot blast | Zn electroplating | 1.2 | 0.34 | 1540 | 2.05 | 83 |
| Comparative Example | shot blast | Zn—Ni alloy electroplating | 3.0 | 0.33 | 1910 | 2.25 | 86 |
| Comparative Example | shot blast | Zn—Fe alloy electroplating | 1.2 | 0.28 | 1008 | 2.08 | 82 |
| Comparative Example | laser (after plating) | Zn hot dipping | 2.9 | 0.21 | 32620 | 2.10 | 86 |

EXAMPLE 5

Table 10 shows a chemical composition of a cold rolled steel sheet used, and Table 11 shows a dulling method for skin pass roll, and surface roughness and properties of the steel sheet. As seen from Table 11, the cold rolled steel sheets according to the invention satisfying $0.3 \leqq Ra \leqq 2.0$, $S \leqq 0.25$, $2{,}000 \leqq SGr \leqq 30{,}000$ and $Ra \times Lmv \geqq 50$ exhibit excellent press formability, distinctness of image after painting and phosphatability as compared with the comparative steel sheets.

TABLE 10

| Steel | C | Si | Mn | P | S | N | Al | X |
|---|---|---|---|---|---|---|---|---|
| C | 0.034 | 0.02 | 0.16 | 0.011 | 0.006 | 0.0035 | 0.042 | — |
| D | 0.002 | 0.01 | 0.11 | 0.008 | 0.004 | 0.0028 | 0.035 | — |
| E | 0.002 | 0.01 | 0.12 | 0.007 | 0.003 | 0.0026 | 0.036 | Ti: 0.022 |
| F | 0.003 | 0.01 | 0.11 | 0.009 | 0.004 | 0.0025 | 0.036 | Nb: 0.014 |

TABLE 10-continued

| Steel | C | Si | Mn | P | S | N | Al | X |
|---|---|---|---|---|---|---|---|---|
| G | 0.002 | 0.01 | 0.08 | 0.008 | 0.005 | 0.0027 | 0.037 | Ti: 0.013<br>Nb: 0.009 |

TABLE 11

| Steel | Roll dulling method | Surface roughness Ra (μm) | S value | Lmv (μm) | SGr (μm²) | Properties YS (kg/mm²) | TS (kg/mm²) | El (%) | r̄ | L.D.R. | Phosphatability | DOI | Remarks |
|---|---|---|---|---|---|---|---|---|---|---|---|---|---|
| C | shot blast | 1.4 | 0.36 | 25.6 | 1630 | 20 | 35 | 45 | 1.4 | 2.09 | 5 | 84 | Comparative Example |
| C | shot blast | 1.3 | 0.44 | 33.7 | 2420 | 20 | 35 | 45 | 1.4 | 2.06 | 4 | 88 | Comparative Example |
| C | laser | 1.5 | 0.20 | 50.6 | 3940 | 20 | 35 | 45 | 1.4 | 2.36 | 1 | 96 | Example |
| D | laser | 1.9 | 0.16 | 70.4 | 11420 | 15 | 28 | 52 | 1.9 | 2.51 | 1 | 97 | Example |
| D | shot blast | 2.3 | 0.35 | 19.6 | 1360 | 15 | 28 | 52 | 1.9 | 2.31 | 4 | 83 | Comparative Example |
| E | shot blast | 1.3 | 0.32 | 30.2 | 2650 | 16 | 29 | 52 | 2.1 | 2.33 | 5 | 88 | Comparative Example |
| E | laser | 1.2 | 0.06 | 46.6 | 3380 | 16 | 29 | 52 | 2.1 | 2.58 | 1 | 95 | Example |
| F | laser | 1.8 | 0.21 | 30.6 | 2160 | 17 | 30 | 50 | 2.0 | 2.55 | 1 | 94 | Example |
| F | shot blast | 1.7 | 0.41 | 12.1 | 1830 | 17 | 30 | 50 | 2.0 | 2.29 | 5 | 82 | Comparative Example |
| G | shot blast | 0.7 | 0.30 | 46.3 | 7860 | 16 | 29 | 51 | 2.2 | 2.30 | 5 | 86 | Comparative Example |
| G | laser | 0.8 | 0.19 | 65.4 | 16430 | 16 | 29 | 51 | 2.2 | 2.56 | 2 | 97 | Example |

EXAMPLE 6

Table 13 shows a dulling method for sking pass roll, kind of plating the surface roughness and properties of the plated steel sheet having a chemical composition as shown in Table 12. As seen from Table 13, the plated steel sheets according to the invention satisfying $0.3 \leqq Ra \leqq 2.0$, $S \leqq 0.25$, $2{,}000 \leqq SGr \leqq 30{,}000$ and $Ra \times Lmv \geqq 50$ exhibit excellent press formability, distinctness of image after painting and phosphatability as compared with the comparative steel sheets.

TABLE 12

| | C | Si | Mn | P | S | N | Al | Ti | Nb |
|---|---|---|---|---|---|---|---|---|---|
| Steel | 0.001 | 0.01 | 0.08 | 0.007 | 0.003 | 0.0029 | 0.051 | 0.019 | 0.006 |

EXAMPLE 7

Table 14 shows a chemical composition of a cold rolled steel sheet used, and Table 15 shows a dulling method for skin pass roll, and surface roughness and properties of the steel sheet. As seen from Table 15, the cold rolled steel sheets according to the invention satisfying $0.3 \leqq Ra \leqq 2.0$, $S \leqq 0.25$, $2{,}000 \leqq SGr \leqq 30{,}000$ and $Rmv/Rmp > 1$ exhibit excellent press formability, distinctness of image after painting and resistance to galling as compared with the comparative steel sheets.

TABLE 14

| Steel | C | Si | Mn | P | S | N | Al | X |
|---|---|---|---|---|---|---|---|---|
| C | 0.035 | 0.02 | 0.21 | 0.019 | 0.008 | 0.0038 | 0.045 | — |
| D | 0.003 | 0.02 | 0.18 | 0.009 | 0.006 | 0.0022 | 0.039 | B:0.002 |
| E | 0.002 | 0.01 | 0.16 | 0.008 | 0.004 | 0.0021 | 0.036 | Ti:0.029 |
| F | 0.002 | 0.01 | 0.17 | 0.010 | 0.005 | 0.0019 | 0.032 | Nb:0.012 |
| G | 0.002 | 0.02 | 0.12 | 0.008 | 0.003 | 0.0026 | 0.037 | Ti:0.008<br>Nb:0.011 |

TABLE 13

| | Roll dulling method | Kind of plating | Surface roughness of plated steel sheet Ra (μm) | S value | SGr (μm²) | Lmv (μm) | Deep drawability (L.D.R.) | DOI | Phosphatability |
|---|---|---|---|---|---|---|---|---|---|
| Example | laser | Zn electroplating | 1.2 | 0.21 | 3240 | 51.2 | 2.30 | 95 | 1 |
| Example | laser | Zn—Ni alloy electroplating | 1.6 | 0.15 | 2730 | 33.6 | 2.32 | 93 | 1 |
| Example | laser | Zn—Fe alloy electroplating | 1.1 | 0.19 | 2310 | 47.4 | 2.28 | 96 | 1 |
| Example | laser (after plating) | Zn hot dipping | 0.8 | 0.09 | 2430 | 63.4 | 2.33 | 91 | 1 |
| Example | laser | Zn electroplating | 1.4 | 0.16 | 15600 | 38.2 | 2.26 | 96 | 1 |
| Example | laser | Zn electroplating | 1.2 | 0.09 | 27410 | 44.1 | 2.22 | 97 | 1 |
| Comparative Example | shot blast | Zn electroplating | 1.1 | 0.34 | 1530 | 41.6 | 2.05 | 83 | 5 |
| Comparative Example | shot blast | Zn—Ni alloy electroplating | 3.1 | 0.33 | 1820 | 14.8 | 2.25 | 86 | 4 |
| Comparative Example | shot blast | Zn—Fe alloy electroplating | 1.3 | 0.29 | 1010 | 35.2 | 2.08 | 82 | 5 |

TABLE 15

| Steel | Roll dulling method | Surface roughness Ra (μm) | S value | Rmv/Rmp | SGr (μm) | Properties YS (kg/mm²) | TS (kg/mm²) | El (%) | r | L.D.R. | Resistance to galling | DOI | Remarks |
|---|---|---|---|---|---|---|---|---|---|---|---|---|---|
| C | shot blast | 1.2 | 0.36 | 0.83 | 2860 | 19 | 34 | 46 | 1.3 | 2.08 | 5 | 82 | Comparative |

TABLE 15-continued

| Steel | Roll dulling method | Surface roughness Ra (μm) | S value | Rmv/Rmp | SGr (μm) | Properties YS (kg/mm²) | TS (kg/mm²) | El (%) | r | L.D.R. | Resistance to galling | DOI | Remarks |
|---|---|---|---|---|---|---|---|---|---|---|---|---|---|
| C | shot blast | 1.3 | 0.34 | 0.88 | 1690 | 19 | 34 | 46 | 1.3 | 2.06 | 5 | 83 | Example Comparative Example |
| C | laser | 1.2 | 0.19 | 1.54 | 2790 | 19 | 34 | 46 | 1.3 | 2.33 | 1 | 95 | Example |
| D | shot blast | 1.9 | 0.29 | 0.92 | 1880 | 15 | 28 | 52 | 1.8 | 2.32 | 4 | 84 | Comparative Example |
| D | laser | 1.8 | 0.20 | 1.23 | 3820 | 15 | 28 | 52 | 1.8 | 2.58 | 1 | 96 | Example |
| E | laser | 1.6 | 0.18 | 1.32 | 2820 | 16 | 29 | 50 | 2.1 | 2.55 | 1 | 95 | Example |
| E | shot blast | 1.5 | 0.39 | 0.73 | 1560 | 16 | 29 | 50 | 2.1 | 2.39 | 5 | 83 | Comparative Example |
| F | shot blast | 0.8 | 0.35 | 0.69 | 1840 | 17 | 30 | 51 | 2.0 | 2.33 | 5 | 84 | Comparative Example |
| F | laser | 0.9 | 0.22 | 1.12 | 7540 | 17 | 30 | 51 | 2.0 | 2.52 | 2 | 97 | Example |
| G | laser | 1.5 | 0.08 | 1.29 | 5520 | 16 | 29 | 50 | 2.2 | 2.56 | 1 | 95 | Example |
| G | shot blast | 1.6 | 0.30 | 0.82 | 1860 | 16 | 29 | 50 | 2.2 | 2.29 | 5 | 84 | Comparative Example |

EXAMPLE 8

Table 17 shows a dulling method for sking pass roll, kind of plating and surface roughness and properties of the plated steel sheet having a chemical composition as shown in Table 16. As seen from Table 17, the plated steel sheets according to the invention satisfying $0.3 \leqq Ra \leqq 2.0$, $S \leqq 0.25$, $2{,}000 \leqq SGr \leqq 30{,}000$ and $Rmv/Rmp > 1$ exhibit excellent press formability, distinctness of image after painting and resistance to galling as compared with the comparative steel sheets.

TABLE 16

| | C | Si | Mn | P | S | N | Al | Ti | Nb |
|---|---|---|---|---|---|---|---|---|---|
| Steel | 0.002 | 0.02 | 0.12 | 0.009 | 0.004 | 0.0019 | 0.061 | 0.026 | 0.011 |

TABLE 17

| | Roll dulling method | Kind of plating | Surface roughness of plated steel sheet Ra (μm) | S value | Rmv/Rmp | SGr (μm²) | Deep drawability (L.D.R.) | Resistance to galling | DOI |
|---|---|---|---|---|---|---|---|---|---|
| Example | laser | Zn electroplating | 1.2 | 0.15 | 1.51 | 2210 | 2.26 | 1 | 94 |
| Example | laser | Zn electroplating | 1.1 | 0.16 | 1.12 | 2340 | 2.34 | 1 | 94 |
| Example | laser | Zn electroplating | 1.2 | 0.19 | 1.65 | 3420 | 2.25 | 1 | 96 |
| Example | laser | Zn electroplating | 1.1 | 0.11 | 1.13 | 3300 | 2.32 | 1 | 95 |
| Example | laser | Zn electroplating | 1.3 | 0.20 | 1.61 | 2380 | 2.31 | 1 | 94 |
| Example | laser | Zn—Ni alloy electroplating | 1.3 | 0.17 | 1.32 | 4210 | 2.28 | 1 | 94 |
| Example | laser | Zn—Fe alloy electroplating | 1.2 | 0.09 | 1.23 | 3150 | 2.26 | 1 | 95 |
| Example | laser (after plating) | Zn hot dipping | 0.9 | 0.13 | 1.20 | 2440 | 2.33 | 2 | 95 |
| Comparative Example | shot blast | Zn electroplating | 1.3 | 0.35 | 0.89 | 1890 | 2.16 | 4 | 75 |
| Comparative Example | shot blast | Zn electroplating | 1.3 | 0.42 | 0.98 | 2240 | 2.07 | 3 | 70 |
| Comparative Example | shot blast | Zn electroplating | 1.1 | 0.38 | 0.86 | 1830 | 2.03 | 5 | 85 |
| Comparative Example | shot blast | Zn electroplating | 1.1 | 0.29 | 0.75 | 2540 | 2.05 | 5 | 88 |
| Comparative Example | shot blast | Zn electroplating | 1.4 | 0.34 | 0.81 | 3220 | 2.05 | 5 | 81 |
| Comparative Example | shot blast | Zn—Ni alloy electroplating | 1.4 | 0.41 | 0.69 | 1850 | 2.01 | 5 | 80 |
| Comparative Example | shot blast | Zn—Fe alloy electroplating | 1.3 | 0.28 | 0.93 | 2110 | 2.00 | 5 | 82 |
| Comparative Example | shot blast (after plating) | Zn hot dipping | 1.2 | 0.36 | 0.86 | 3120 | 2.09 | 5 | 83 |

EXAMPLE 9

Table 18 shows a chemical composition of a cold rolled steel sheet used, and Table 19 shows a dulling method for skin pass roll, and surface roughness and properties of the steel sheet. As seen from Table 19, the cold rolled steel sheets according to the invention satisfying $0.3 \leqq Ra \leqq 2.0$, $S \leqq 0.25$, $2{,}000 \leqq SGr \leqq 30{,}000$ and $SSr \geqq 45$ exhibit excellent press formability, distinctness of image after painting and spot weldability as compared with the comparative steel sheets.

TABLE 18

| Steel | C | Si | Mn | P | S | N | Al | X |
|---|---|---|---|---|---|---|---|---|
| C | 0.033 | 0.02 | 0.20 | 0.013 | 0.007 | 0.0041 | 0.043 | — |
| D | 0.002 | 0.01 | 0.09 | 0.009 | 0.005 | 0.0026 | 0.029 | — |
| E | 0.003 | 0.01 | 0.12 | 0.011 | 0.003 | 0.0029 | 0.031 | Ti:0.033 |
| F | 0.002 | 0.01 | 0.15 | 0.007 | 0.004 | 0.0031 | 0.028 | Nb:0.013 |
| G | 0.004 | 0.01 | 0.13 | 0.010 | 0.003 | 0.0025 | 0.033 | Ti:0.009 Nb:0.010 |

TABLE 19

| Steel | Roll dulling method | Surface roughness Ra (μm) | S value | SSr (%) | SGr (μm²) | Properties YS (kg/mm²) | TS (kg/mm²) | El (%) | r | L.D.R. | Tensile shearing force (kg/mm²) | DOI | Remarks |
|---|---|---|---|---|---|---|---|---|---|---|---|---|---|
| C | shot blast | 1.6 | 0.36 | 42 | 2820 | 19 | 35 | 45 | 1.3 | 2.08 | 353 | 81 | Comparative Example |
| C | shot blast | 1.5 | 0.33 | 33 | 3660 | 19 | 35 | 45 | 1.3 | 2.05 | 341 | 84 | Comparative Example |
| C | laser | 1.6 | 0.19 | 56 | 5420 | 19 | 35 | 45 | 1.3 | 2.35 | 482 | 95 | Example |
| D | shot blast | 1.2 | 0.41 | 39 | 1220 | 15 | 28 | 52 | 1.9 | 2.31 | 342 | 82 | Comparative Example |
| D | laser | 1.1 | 0.22 | 62 | 6930 | 15 | 28 | 52 | 1.9 | 2.51 | 452 | 96 | Example |
| E | shot blast | 0.9 | 0.32 | 41 | 2860 | 16 | 28 | 51 | 2.1 | 2.33 | 351 | 84 | Comparative Example |
| E | laser | 0.8 | 0.09 | 48 | 11220 | 16 | 28 | 51 | 2.1 | 2.59 | 446 | 97 | Example |
| F | laser | 1.2 | 0.11 | 51 | 1820 | 16 | 29 | 50 | 2.0 | 2.53 | 449 | 92 | Comparative Example |
| F | shot blast | 1.3 | 0.29 | 40 | 2290 | 16 | 29 | 50 | 2.0 | 2.35 | 340 | 83 | Comparative Example |
| G | laser | 0.5 | 0.23 | 49 | 2290 | 17 | 30 | 50 | 2.1 | 2.50 | 445 | 95 | Example |
| G | shot blast | 0.6 | 0.43 | 37 | 5230 | 17 | 30 | 50 | 2.1 | 2.31 | 338 | 84 | Comparative Example |

EXAMPLE 10

Table 21 shows a dulling method for sking pass roll, kind of plating and surface rougness and properties of the plated steel sheet having a chemical composition as shown in Table 20. As seen from Table 21, the plated steel sheets according to the invention satisfying $0.3 \leqq Ra \leqq 2.0$, $S \leqq 0.25$, $2{,}000 \leqq SGr \leqq 30{,}000$ and $SSr \geqq 45$ exhibit excellent press formability, distinctness of image after painting and spot weldability as compared with the comparative steel sheets.

TABLE 20

| | C | Si | Mn | P | S | N | Al | Ti |
|---|---|---|---|---|---|---|---|---|
| Steel | 0.002 | 0.02 | 0.09 | 0.010 | 0.008 | 0.0022 | 0.043 | 0.044 |

TABLE 21

| | Roll dulling method | Kind of plating | Surface roughness of plates steel sheet Ra (μm) | Rz (μm) | S value | SSr (%) | SGr (μm²) | Tensile shearing force (kg/mm²) | Deep drawability (L.D.R.) | DOI | Remarks |
|---|---|---|---|---|---|---|---|---|---|---|---|
| Example | laser | Zn electroplating | 1.9 | 10.0 | 0.21 | 48 | 2980 | 443 | 2.21 | 95 | |
| Example | laser | Zn—Fe alloy electroplating | 2.0 | 10.4 | 0.20 | 52 | 3380 | 451 | 2.23 | 94 | |
| Example | laser | Zn electroplating | 0.5 | 0.86 | 0.16 | 49 | 12500 | 431 | 2.21 | 97 | |
| Example | laser | Zn electroplating | 0.4 | 1.24 | 0.18 | 56 | 6850 | 429 | 2.20 | 95 | |
| Example | laser | Zn electroplating | 1.1 | 5.0 | 0.12 | 61 | 5120 | 440 | 2.30 | 95 | |
| Example | laser | Zn—Ni alloy electroplating | 1.3 | 5.9 | 0.23 | 48 | 4280 | 451 | 2.21 | 94 | |
| Example | laser (after plating) | Zn hot dipping | 1.1 | 4.4 | 0.15 | 50 | 3860 | 428 | 2.24 | 93 | |
| Comparative Example | shot blast | Zn electroplating | 2.1 | 9.5 | 0.34 | 42 | 1230 | 382 | 2.05 | 67 | |
| Comparative Example | shot blast | Zn electroplating | 0.2 | 0.8 | 0.30 | 43 | 2890 | 336 | 2.02 | 73 | reskin pass after plating |
| Comparative Example | shot blast | Zn—Ni alloy electroplating | 1.2 | 5.4 | 0.35 | 38 | 3340 | 354 | 2.03 | 68 | |
| Comparative Example | shot blast | Zn—Fe alloy electroplating | 0.6 | 3.0 | 0.38 | 36 | 2140 | 339 | 2.05 | 68 | |
| Comparative Example | shot blast (after plating) | Zn hot dipping | 1.2 | 4.8 | 0.40 | 40 | 2290 | 368 | 2.00 | 65 | |

EXAMPLE 11

Table 22 shows a chemical composition of a cold rolled steel sheet used, and Table 23 shows a dulling method for skin pass roll, and surface roughness and properties of the steel sheet. As seen from Table 23, the cold rolled steel sheets according to the invention satisfying $0.3 \leqq Ra \leqq 2.0$, $S \leqq 0.25$, $2{,}000 \leqq SGr \leqq 30{,}000$, $Ra \times Lmv \geqq 50$ and $Rmv/Rmp > 1$ exhibit excellent press formability, distinctness of image after painting, phosphatability and resistance to galling as compared with the comparative steel sheets.

TABLE 22

| Steel | C | Si | Mn | P | S | N | Al | X |
|---|---|---|---|---|---|---|---|---|
| C | 0.035 | 0.03 | 0.24 | 0.019 | 0.009 | 0.0034 | 0.045 | — |
| D | 0.003 | 0.02 | 0.18 | 0.009 | 0.006 | 0.0022 | 0.039 | Ti:0.024 Nb:0.009 B:0.0009 |
| E | 0.002 | 0.01 | 0.16 | 0.008 | 0.004 | 0.0021 | 0.036 | Ti:0.038 |

TABLE 23

| Steel | Roll dulling method | Surface roughness Ra (μm) | S value | Rmv/Rmp | Lmv (μm) | SGr (μm²) | Properties YS (kg/mm²) | TS (kg/mm²) | El (%) | r | L.D.R. | Resistance to galling | Phosphatability | DOI | |
|---|---|---|---|---|---|---|---|---|---|---|---|---|---|---|---|
| C | shot blast | 1.2 | 0.33 | 0.82 | 39.2 | 1790 | 19 | 35 | 47 | 1.3 | 2.06 | 5 | 4 | 84 | Comparative Example |
| C | shot blast | 1.3 | 0.31 | 0.86 | 32.1 | 1090 | 19 | 35 | 47 | 1.3 | 2.05 | 5 | 5 | 83 | Comparative Example |
| C | laser | 1.2 | 0.16 | 1.53 | 116.8 | 4580 | 19 | 35 | 47 | 1.3 | 2.36 | 1 | 1 | 97 | Example |
| D | shot blast | 0.7 | 0.27 | 0.91 | 14.8 | 210 | 16 | 29 | 51 | 1.9 | 2.34 | 4 | 5 | 82 | Comparative Example |
| D | laser | 0.8 | 0.22 | 1.22 | 66.3 | 2320 | 16 | 29 | 51 | 1.9 | 2.59 | 1 | 1 | 96 | Example |
| E | laser | 1.6 | 0.16 | 1.33 | 83.2 | 3070 | 16 | 28 | 50 | 2.1 | 2.57 | 1 | 1 | 97 | Example |
| E | shot blast | 1.5 | 0.36 | 0.76 | 18.6 | 470 | 16 | 28 | 50 | 2.1 | 2.46 | 5 | 4 | 82 | Comparative Example |

EXAMPLE 12

Table 25 shows a dulling method for sking pass roll, kind of plating and surface roughness and properties of the plated steel sheet having a chemical composition as shown in Table 24. As seen from Table 25, the plates steel sheets according to the invention satisfying $0.3 \leqq Ra \leqq 2.0$, $S \leqq 0.25$, $2{,}000 \leqq SGr \leqq 30{,}000$, $Ra \times Lmv \geqq 50$ and $Rmv/Rmp > 1$ exhibit excellent press formability, distinctness of image after painting, phosphatability and resistance to galling as compared with the comparative steel sheets.

TABLE 24

| | C | Si | Mn | P | S | N | Al | Ti | Nb |
|---|---|---|---|---|---|---|---|---|---|
| Steel | 0.002 | 0.01 | 0.10 | 0.007 | 0.005 | 0.0018 | 0.051 | 0.031 | 0.006 |

TABLE 25

| | Roll dulling method | Kind of plating | Surface roughness of plated steel sheet Ra (μm) | S value | Rmv/Rmp | Lmv (μm) | SGr (μm²) | Deep drawability (L.D.R.) | Resistance to galling | DOI | Phosphatability |
|---|---|---|---|---|---|---|---|---|---|---|---|
| Example | laser | Zn electroplating | 1.3 | 0.16 | 1.24 | 68.3 | 2380 | 2.26 | 1 | 93 | 1 |
| Example | laser | Zn electroplating | 1.1 | 0.19 | 1.15 | 75.0 | 3340 | 2.25 | 1 | 96 | 1 |
| Example | laser | Zn electroplating | 1.3 | 0.21 | 1.33 | 79.8 | 2830 | 2.31 | 1 | 94 | 1 |
| Example | laser | Zn—Fe alloy electroplating | 1.1 | 0.09 | 1.23 | 70.2 | 2560 | 2.24 | 1 | 95 | 1 |
| Comparative Example | shot blast | Zn electroplating | 1.4 | 0.36 | 0.76 | 33.8 | 1550 | 2.06 | 5 | 75 | 4 |
| Comparative Example | shot blast | Zn electroplating | 1.2 | 0.38 | 0.86 | 37.2 | 1470 | 2.03 | 5 | 85 | 5 |
| Comparative Example | shot blast | Zn—Ni alloy electroplating | 1.4 | 0.41 | 0.69 | 31.2 | 1610 | 2.05 | 5 | 80 | 5 |

EXAMPLE 13

Table 26 shows a chemical composition of a cold rolled steel sheet used, and Table 27 shows a dulling method for skin pass roll, and surface roughness and properties of the steel sheet. As seen from Table 27, the cold rolled steel sheets according to the invention satisfying $0.3 \leqq Ra \leqq 2.0$, $S \leqq 0.25$, $2{,}000 \leqq SGr \leqq 30{,}000$, $Ra \times Lmv \geqq 50$ and $SSr \geqq 45$ exhibit excellent press formability, distinctness of image after painting, phosphatability and spot weldability as compared with the comparative steel sheets.

TABLE 26

| Steel | C | Si | Mn | P | S | N | Al | X |
|---|---|---|---|---|---|---|---|---|
| C | 0.036 | 0.02 | 0.21 | 0.012 | 0.007 | 0.0038 | 0.046 | — |
| D | 0.002 | 0.01 | 0.20 | 0.005 | 0.004 | 0.0029 | 0.030 | Ti: 0.0022 Nb: 0.009 |
| E | 0.002 | 0.01 | 0.12 | 0.004 | 0.005 | 0.0023 | 0.031 | B: 0.0008 Ti: 0.033 |

TABLE 27

| Steel | Roll dulling method | Surface roughness Ra (μm) | S value | SSr (%) | SGr (μm²) | Lmv (μm) | Properties YS (kg/mm²) | TS (kg/mm²) | El (%) | r̄ | L.D.R. | Tensile shearing force (kg/mm²) | DOI | Phosphatability | Remarks |
|---|---|---|---|---|---|---|---|---|---|---|---|---|---|---|---|
| C | shot blast | 1.6 | 0.34 | 41 | 340 | 30.1 | 19 | 34 | 45 | 1.3 | 2.02 | 352 | 82 | 4 | Comparative Example |
| C | shot blast | 1.5 | 0.32 | 44 | 430 | 29.8 | 19 | 34 | 45 | 1.3 | 2.03 | 340 | 80 | 5 | Compar- |

TABLE 27-continued

| Steel | Roll dulling method | Surface roughness Ra (μm) | S value | SSr (%) | SGr (μm²) | Lmv (μm) | Properties YS (kg/mm²) | TS (kg/mm²) | El (%) | r̄ | L.D.R. | Tensile shearing force (kg/mm²) | DOI | Phosphatability | Remarks |
|---|---|---|---|---|---|---|---|---|---|---|---|---|---|---|---|
| | | | | | | | | | | | | | | | ative Example |
| C | laser | 1.6 | 0.19 | 55 | 2770 | 48.6 | 19 | 34 | 45 | 1.3 | 2.33 | 486 | 96 | 1 | Example |
| D | shot blast | 1.2 | 0.42 | 39 | 480 | 38.6 | 15 | 28 | 51 | 1.9 | 2.32 | 341 | 83 | 5 | Comparative Example |
| D | laser | 1.1 | 0.21 | 61 | 4480 | 48.3 | 15 | 28 | 51 | 1.9 | 2.53 | 454 | 97 | 1 | Example |
| E | shot blast | 0.9 | 0.33 | 42 | 1040 | 50.2 | 16 | 28 | 52 | 2.2 | 2.34 | 352 | 84 | 5 | Comparative Example |
| E | laser | 0.8 | 0.10 | 48 | 3580 | 73.1 | 16 | 28 | 52 | 2.2 | 2.56 | 446 | 96 | 1 | Example |

EXAMPLE 14

Table 29 shows a dulling method for sking pass roll, kind of plating and surface roughness and properties of the plated steel sheet having a chemical composition as shown in Table 28. As seen from Table 29 the plated steel sheets according to the invention satisfying $0.3 \leqq Ra \leqq 2.0$, $S \leqq 0.25$, $2{,}000 \leqq SGr \leqq 30{,}000$, $Ra \times Lmv \geqq 50$ and $SSr \geqq 45$ exhibit excellent press formability, distinctness of image after painting, phosphatability and spot weldability as compared with the comparative steel sheets.

TABLE 28

| | C | Si | Mn | P | S | N | Al | Ti | Nb |
|---|---|---|---|---|---|---|---|---|---|
| Steel | 0.002 | 0.02 | 0.09 | 0.009 | 0.003 | 0.0014 | 0.063 | 0.013 | 0.012 |

EXAMPLE 15

Table 30 shows a chemical composition of a cold rolled steel sheet used, and Table 31 shows a dulling method for skin pass roll, and surface roughness and properties of the steel sheet. As seen from Table 31, the cold rolled steel sheets according to the invention satisfying $0.3 \leqq Ra \leqq 2.0$, $S \leqq 0.245$, $2{,}000 \leqq SGr \leqq 30{,}000$, $Rmv/Rmp > 1$ and $SSr \geqq 45$ exhibit excellent press formability, distinctness of image after painting, resistance to galling and spot weldability as compared with the comparative steel sheets.

TABLE 30

| Steel | C | Si | Mn | P | S | N | Al | X |
|---|---|---|---|---|---|---|---|---|
| C | 0.033 | 0.02 | 0.22 | 0.013 | 0.006 | 0.0045 | 0.043 | — |
| D | 0.002 | 0.01 | 0.09 | 0.009 | 0.005 | 0.0026 | 0.029 | Ti: 0.0029 Nb: 0.011 |
| E | 0.003 | 0.01 | 0.14 | 0.011 | 0.004 | 0.0029 | 0.031 | B: 0.0012 Ti: 0.033 |

TABLE 29

| | Roll dulling method | Kind of plating | Surface roughness of plated steel sheet Ra (μm) | S value | SSr (%) | Lmv (μm) | SGr (μm²) | Deep drawability (L.D.R.) | DOI | Phosphat ability | Tensile shearing force (kg/mm²) | Remarks |
|---|---|---|---|---|---|---|---|---|---|---|---|---|
| Example | laser | Zn electroplating | 2.0 | 0.16 | 48 | 60.4 | 2440 | 2.29 | 94 | 1 | 453 | |
| Example | laser | Zn electroplating | 0.6 | 0.16 | 51 | 90.2 | 6920 | 2.29 | 97 | 1 | 482 | |
| Example | laser | Zn electroplating | 0.8 | 0.18 | 62 | 64.3 | 8640 | 2.35 | 95 | 2 | 476 | |
| Example | laser | Zn—Ni alloy electroplating | 1.4 | 0.24 | 54 | 45.2 | 2210 | 2.21 | 92 | 1 | 473 | |
| Example | laser (after plating) | Zn hot dipping | 1.2 | 0.16 | 49 | 53.6 | 2080 | 2.26 | 93 | 1 | 452 | |
| Comparative Example | shot blast | Zn electroplating | 2.1 | 0.35 | 44 | 22.8 | 250 | 2.05 | 67 | 5 | 362 | |
| Comparative Example | shot blast | Zn electroplating | 1.2 | 0.33 | 43 | 38.4 | 660 | 2.02 | 73 | 4 | 373 | reskin pass after plating |
| Comparative Example | shot blast | Zn electroplating | 0.8 | 0.41 | 42 | 58.3 | 1400 | 2.05 | 70 | 5 | 381 | reskin pass after plating |

TABLE 31

| Steel | Roll dulling method | Surface roughness Ra (μm) | S value | SSr (%) | SGr (μm²) | Rmv/Rmp | Properties YS (kg/mm²) | TS (kg/mm²) | El (%) | r̄ | L.D.R. | Tensile shearing force (kg/mm²) | DOI | Resistance to galling | Remarks |
|---|---|---|---|---|---|---|---|---|---|---|---|---|---|---|---|
| C | shot blast | 1.5 | 0.33 | 43 | 1060 | 1.33 | 19 | 34 | 45 | 1.3 | 2.07 | 352 | 84 | 4 | Comparative |

TABLE 31-continued

| Steel | Roll dulling method | Surface roughness Ra (μm) | S value | SSr (%) | SGr (μm²) | Rmv/Rmp | Properties YS (kg/mm²) | TS (kg/mm²) | El (%) | r̄ | L.D.R. | Tensile shearing force (kg/mm²) | DOI | Resistance to galling | Remarks |
|---|---|---|---|---|---|---|---|---|---|---|---|---|---|---|---|
| C | shot blast | 1.4 | 0.32 | 41 | 1090 | 1.44 | 19 | 34 | 45 | 1.3 | 2.06 | 345 | 83 | 4 | Example Comparative Example |
| C | laser | 1.5 | 0.21 | 47 | 2840 | 1.13 | 19 | 34 | 45 | 1.3 | 2.36 | 483 | 94 | 1 | Example |
| D | shot blast | 1.2 | 0.43 | 40 | 2120 | 1.50 | 16 | 28 | 51 | 1.9 | 2.32 | 341 | 85 | 3 | Comparative Example |
| D | laser | 1.2 | 0.21 | 48 | 3840 | 1.08 | 16 | 28 | 51 | 1.9 | 2.50 | 453 | 97 | 1 | Example |
| E | shot blast | 0.9 | 0.32 | 42 | 2250 | 1.38 | 15 | 29 | 52 | 2.1 | 2.34 | 350 | 84 | 4 | Comparative Example |
| E | laser | 1.0 | 0.08 | 49 | 4160 | 1.04 | 15 | 29 | 52 | 2.1 | 2.56 | 448 | 96 | 2 | Example |

EXAMPLE 16

Table 33 shows a dulling method for sking pass roll, kind of plating and surface roughness and properties of the plated steel sheet having a chemical composition as shown in Table 32. As seen from Table 33, the plated steel sheets according to the invention satisfying $0.3 \leqq Ra \leqq 2.0$, $S \leqq 0.25$, $2{,}000 \leqq SGr \leqq 30{,}000$, $Rmv/Rmp > 1$ and $SSr \geqq 45$ exhibit excellent press formability, distinctness of image after painting, resistance to galling and spot weldability as compared with the comparative steel sheets.

TABLE 32

| | C | Si | Mn | P | S | N | Al | Ti | Nb |
|---|---|---|---|---|---|---|---|---|---|
| Steel | 0.001 | 0.02 | 0.08 | 0.008 | 0.008 | 0.0018 | 0.044 | 0.016 | 0.008 |

TABLE 33

| | Roll dulling method | Kind of plating | Surface roughness of plated steel sheet Ra (μm) | S value | Rmv/Rmp | SSr (%) | SGr (μm²) | Deep drawability (L.D.R.) | Resistance to galling | DOI | Tensile shearing force (kg/mm²) |
|---|---|---|---|---|---|---|---|---|---|---|---|
| Example | laser | Zn electroplating | 1.2 | 0.14 | 1.13 | 47 | 2060 | 2.24 | 1 | 94 | 438 |
| Example | laser | Zn electroplating | 1.2 | 0.19 | 1.17 | 46 | 2850 | 2.26 | 1 | 96 | 443 |
| Example | laser | Zn—Ni alloy electroplating | 1.4 | 0.16 | 1.08 | 48 | 3620 | 2.27 | 1 | 94 | 439 |
| Comparative Example | shot blast | Zn electroplating | 1.3 | 0.38 | 1.38 | 42 | 1860 | 2.06 | 5 | 75 | 352 |
| Comparative Example | shot blast | Zn electroplating | 1.1 | 0.38 | 1.44 | 41 | 2240 | 2.01 | 4 | 85 | 348 |
| Comparative Example | shot blast | Zn electroplating | 1.3 | 0.34 | 1.27 | 44 | 3810 | 2.04 | 5 | 81 | 339 |

EXAMPLE 17

Table 34 shows a chemical composition of a cold rolled steel sheet used, and Table 35 shows a dulling method for skin pass roll, and surface roughness and properties of the steel sheet. As seen from Table 35, the cold rolled steel sheets according to the invention satisfying $0.3 \leqq Ra \leqq 2.0$, $S \leqq 0.25$, $2{,}000 \leqq SGr \leqq 30{,}000$, $Ra \times Lmv \geqq 50$, $Rmv/Rmp > 1$ and $SSr \geqq 45$ exhibit excellent press formability, distinctness of image after painting, phosphatability, resistance to galling and spot weldability as compared with the comparative steel sheets.

TABLE 34

| Steel | C | Si | Mn | P | S | N | Al | X |
|---|---|---|---|---|---|---|---|---|
| C | 0.035 | 0.02 | 0.22 | 0.019 | 0.006 | 0.0041 | 0.045 | — |
| D | 0.003 | 0.02 | 0.18 | 0.009 | 0.006 | 0.0022 | 0.039 | Ti: 0.029 Nb: 0.009 B: 0.0008 |
| E | 0.002 | 0.01 | 0.16 | 0.008 | 0.004 | 0.0021 | 0.036 | Ti: 0.034 |

TABLE 35

| Steel | Roll dulling method | Surface roughness Ra (μm) | S value | Rmv/Rmp | SGr (μm²) | Lmv (μm) | SSr (%) | Properties YS (kg/mm²) | TS (kg/mm²) | El (%) | r̄ | L.D.R. | Resistance to galling | Tensile shearing force (kg/mm²) | DOI | Phosphatability | |
|---|---|---|---|---|---|---|---|---|---|---|---|---|---|---|---|---|---|
| C | shot blast | 1.2 | 0.32 | 0.82 | 1310 | 33.5 | 55 | 19 | 34 | 46 | 1.3 | 2.01 | 5 | 413 | 82 | 5 | Comparative Example |

TABLE 35-continued

| Steel | Roll dulling method | Surface roughness Ra (μm) | S value | Rmv/Rmp | SGr (μm²) | Lmv (μm) | SSr (%) | Properties YS (kg/mm²) | TS (kg/mm²) | El (%) | r̄ | L.D.R. | Resistance to galling | Tensile shearing force (kg/mm²) | DOI | Phosphatability | |
|---|---|---|---|---|---|---|---|---|---|---|---|---|---|---|---|---|---|
| C | shot blast | 1.2 | 0.38 | 0.86 | 1640 | 39.3 | 54 | 19 | 34 | 46 | 1.3 | 2.05 | 5 | 408 | 84 | 5 | Comparative Example |
| C | laser | 1.3 | 0.21 | 1.08 | 3220 | 69.2 | 48 | 19 | 34 | 46 | 1.3 | 2.32 | 1 | 451 | 96 | 2 | Example |
| D | shot blast | 2.0 | 0.27 | 0.94 | 370 | 20.3 | 52 | 16 | 29 | 51 | 1.8 | 2.36 | 4 | 402 | 83 | 5 | Comparative Example |
| D | laser | 1.9 | 0.21 | 1.21 | 2170 | 63.6 | 45 | 16 | 29 | 51 | 1.8 | 2.59 | 1 | 421 | 94 | 1 | Example |
| E | laser | 1.9 | 0.19 | 1.12 | 3200 | 71.5 | 47 | 16 | 29 | 50 | 2.2 | 2.53 | 1 | 461 | 97 | 1 | Example |

EXAMPLE 18

Table 37 shows a dulling method for sking pass roll, kind of plating and surface roughness and properties of the plates steel sheet having a chemical composition as shown in Table 36. As seen from Table 37, the plated steel sheets according to the invention satisfying $0.3 \leqq Ra \leqq 2.0$, $S \leqq 0.25$, $2{,}000 \leqq SGr \leqq 30{,}000$, $Ra \times Lmv \geqq 50$, $Rmv/Rmp > 1$ and $SSr \geqq 45$ exhibit excellent press formability, distinctness of image after painting, phosphatability, resistance to galling and spot weldability as compared with the comparative steel sheets.

TABLE 36

| | C | Si | Mn | P | S | N | Al | Ti | Nb | B |
|---|---|---|---|---|---|---|---|---|---|---|
| Steel | 0.002 | 0.01 | 0.11 | 0.009 | 0.005 | 0.0015 | 0.032 | 0.011 | 0.005 | 0.0011 |

TABLE 37

| | Roll dulling method | Kind of plating | Surface roughness of plated steel sheet Ra (μm) | S value | Rmv/Rmp | SGr (μm²) | Lmv (μm) | SSr (%) | Deep drawability (L.D.R.) | Resistance to galling | DOI | Tensile shearing force (kg/mm²) | Phosphatability |
|---|---|---|---|---|---|---|---|---|---|---|---|---|---|
| Example | laser | Zn electroplating | 1.3 | 0.13 | 1.08 | 2440 | 60.4 | 48 | 2.26 | 1 | 93 | 481 | 1 |
| Example | laser | Zn—Ni alloy electroplating | 0.8 | 0.17 | 1.12 | 3040 | 70.1 | 47 | 2.21 | 1 | 96 | 471 | 1 |
| Example | laser | Zn—Fe alloy electroplating | 1.9 | 0.18 | 1.20 | 2130 | 63.6 | 45 | 2.32 | 1 | 92 | 432 | 1 |
| Comparative Example | shot blast | Zn electroplating | 1.4 | 0.36 | 0.94 | 860 | 30.6 | 52 | 2.06 | 4 | 75 | 425 | 5 |
| Comparative Example | shot blast | Zn electroplating | 1.1 | 0.38 | 0.86 | 1760 | 40.3 | 54 | 2.00 | 5 | 85 | 436 | 5 |

As mentioned above, according to the invention, the regular surface roughness pattern is given to the surface of the cold rolled or plated steel sheet and factors thereof are controlled to given levels, whereby cold rolled steel sheets and plated steel sheets having improved press formability as well as excellent phosphatability, resistance to galling and spot weldability can be produced.

What is claimed is:

1. A cold rolled steel sheet having an improved press formability, characterized in that said steel sheet has a surface roughness pattern satisfying a center-line average surface roughness (Ra, μm) of 0.3–2.0 and a regularity parameter (S) in at least one direction of not more than 0.25 showing a regularity of surface roughness represented by the following equations:

$$S = \frac{1}{n} \sum_{i=1}^{n} \frac{|\overline{X} - Xi|}{\overline{X}}$$

$$\overline{X} = \frac{1}{n} \sum_{i=1}^{n} Xi$$

wherein Xi is a distance between peaks of convex portions at the surface of the steel sheet.

2. The cold rolled steel sheet according to claim 1, wherein said surface roughness pattern further satisfies a mean area per one convex portion at center plane of surface roughness (SGr, μm²) of 2,000–30,000.

3. The cold rolled steel sheet according to claim 1, wherein said surface roughness pattern further satisfies a mean area per one convex portion at center plane of surface roughness (SGr, μm²) of 2,000–30,000 and a product of center-line average surface roughness (Ra, μm) and mean concave distance (Lmv, μm) of not less than 50.

4. The cold rolled steel sheet according to claim 1, wherein said surface roughness pattern further satisfies a mean area per one convex portion at center plane of surface roughness (SGr, $\mu m^2$) of 2,000–30,000 and a ratio of mean concave radius (Rmv, μm) to mean convex radius (Rmp, μm) of more than 1.

5. The cold rolled steel sheet according to claim 1, wherein said surface roughness pattern further satisfies a mean area per one convex portion at center plane of surface roughness (SGr, $\mu m^2$) of 2,000–30,000 and a mean area ratio of convex portions at center plane of surface roughness (SSr, %) of not less than 45.

6. The cold rolled steel sheet according to claim 1, wherein said surface roughness pattern further satisfies a mean area per one convex portion at center plane of surface roughness (SGr, $\mu m^2$) of 2,000–30,000, a product of center-line average surface roughness (Ra, μm) and mean concave distance (Lmv, μm) of not less than 50, and a ratio of mean concave radius (Rmv, μm) to mean convex radius (Rmp, μm) of more than 1.

7. The cold rolled steel sheet according to claim 1, wherein said surface roughness pattern further satisfies a mean area per one convex portion at center plane of surface roughness (SGr, μm) of 2,000–30,000, a product of center-line average surface roughness (Ra, μm) and mean concave distance (Lmv, μm) of not less than 50, and a mean area ratio of convex portions at center plane of surface roughness (SSr, %) of not less than 45.

8. The cold rolled steel sheet according to claim 1, wherein said surface roughness pattern further satisfies a mean area per one convex portion at center plane of surface roughness (SGr, $\mu m^2$) of 2,000–30,000, a ratio of mean concave radius (Rmv, μm) to mean convex radius (Rmp, μm) of more than 1, and a mean area ratio of convex portions at center plane of surface roughness (SSr, %) of not less than 45.

9. The cold rolled steel sheet according to claim 1, wherein said surface roughness pattern further satisfies a mean area per one convex portion at center plane of surface roughness (SGr, $\mu m^2$) of 2,000–30,000, a product of center-line average surface roughness (Ra, μm) and mean concave distance (Lmv, μm) of not less than 50, a ratio of mean concave radius (Rmv, μm) to mean convex radius (Rmp, μm) of more than 1, and a mean area ratio of convex portions at center plane of surface roughness (SSr, %) of not less than 45.

10. A plated steel sheet having an improved press formability, characterized in that said steel sheet has a surface roughness pattern satisfying a center-line average surface roughness (Ra, μm) of 0.3–2.0 and a regularity parameter (S) in at least one direction of not more than 0.25 showing a regularity of surface roughness represented by the following equations:

$$S = \frac{1}{n} \sum_{i=1}^{n} \frac{|\overline{X} - Xi|}{\overline{X}}$$

-continued $$\overline{X} = \frac{1}{n} \sum_{i=1}^{n} Xi$$

wherein Xi is a distance between peaks of convex portions at the surface of the steel sheet.

11. The plated steel sheet according to claim 10, wherein said surface roughness pattern further satisfies a mean area per one convex portion at center plane of surface roughness (SGr, $\mu m^2$) of 2,000–30,000.

12. The plated steel sheet according to claim 10, wherein said surface roughness pattern further satisfies a mean area per one convex portion at center plane of surface roughness (SGr, $\mu m^2$) of 2,000–30,000 and a product of center-line average surface roughness (Ra, μm) and mean concave distance (Lmv, μm) of not less than 50.

13. The plated steel sheet according to claim 10, wherein said surface roughness pattern further satisfies a mean area per one convex portion at center plane of surface roughness (SGr, $\mu m^2$) of 2,000–30,000 and a ratio of mean concave radius (Rmv, μm) to mean convex radius (Rmp, μm) of more than 1.

14. The plated steel sheet according to claim 10, wherein said surface roughness pattern further satisfies a mean area per one convex portion at center plane of surface roughness (SGr, $\mu m^2$) of 2,000–30,000 and a mean area ratio of convex portions at center plane of surface roughness (SSr, %) of not less than 45.

15. The plated steel sheet according to claim 10, wherein said surface roughness pattern further satisfies a mean area per one convex portion at center plane of surface roughness (SGr, $\mu m^2$) of 2,000–30,000, a product of center-line average surface roughness (Ra, μm) and mean concave distance (Lmv, μm) of not less than 50, and a ratio of mean concave radius (Rmv, μm) to mean convex radius (Rmp, μm) of more than 1.

16. The plated steel sheet according to claim 10, wherein said surface roughness pattern further satisfies a mean area per one convex portion at center plane of surface roughness (SGr, μm) of 2,000–30,000, a product of center-line average surface roughness (Ra, μm) and mean concave distance (Lmv, μm) of not less than 50, and a mean area ratio of convex portions at center plane of surface roughness (SSr, %) of not less than 45.

17. The plated steel sheet according to claim 10, wherein said surface roughness pattern further satisfies a mean area per one convex portion at center plane of surface roughness (SGr, $\mu m^2$) of 2,000–30,000, a ratio of mean concave radius (Rmv, μm) to mean convex radius (Rmp, μm) of more than 1, and a mean area ratio of convex portions at center plane of surface roughness (SSr, %) of not less than 45.

18. The plated steel sheet according to claim 10, wherein said surface roughness pattern further satisfies a mean area per one convex portion at center plane of surface roughness (SGr, $\mu m^2$) of 2,000–30,000, a product of center-line average surface roughness (Ra, μm) and mean concave distance (Lmv, μm) of not less than 50, a ratio of mean concave radius (Rmv, μm) to mean convex radius (Rmp, μm) of more than 1, and a mean ratio of convex portions at center plane of surface roughness (SSr, %) of not less than 45.

* * * * *